US008193995B2

(12) United States Patent
Mojarradi et al.

(10) Patent No.: US 8,193,995 B2
(45) Date of Patent: Jun. 5, 2012

(54) INTEGRATED ULTRA THIN SCALABLE 94 GHZ SI POWER SOURCE

(75) Inventors: Mohammad M. Mojarradi, La Canada, CA (US); Goutam Chattopadhyay, Pasadena, CA (US); Harish Manohara, Arcadia, CA (US); Hadi Mojaradi, Northridge, CA (US)

(73) Assignee: California Institute of Technology, Pasadena, CA (US)

( * ) Notice: Subject to any disclaimer, the term of this patent is extended or adjusted under 35 U.S.C. 154(b) by 496 days.

(21) Appl. No.: 12/468,253

(22) Filed: May 19, 2009

(65) Prior Publication Data

US 2010/0039342 A1 Feb. 18, 2010

Related U.S. Application Data

(60) Provisional application No. 61/128,227, filed on May 20, 2008.

(51) Int. Cl.
*H01Q 13/10* (2006.01)

(52) U.S. Cl. ..... 343/770

(58) Field of Classification Search ..... 343/767, 343/776, 784, 770
See application file for complete search history.

*Primary Examiner* — Huedung Mancuso
(74) *Attorney, Agent, or Firm* — Steinfl & Bruno LLP

(57) ABSTRACT

In one embodiment, a slot array antenna comprising a quartz layer and a silicon layer, wherein the quartz and silicon layers are matched to suppress microwave modes, and a metal layer adjacent to the silicon layer comprising offset cuts.

11 Claims, 8 Drawing Sheets

INTEGRATED ULTRA THIN SCALABLE 94 GHZ SI POWER SOURCE

DESCRIPTION OF THE EMBODIMENTS

Figure 9:
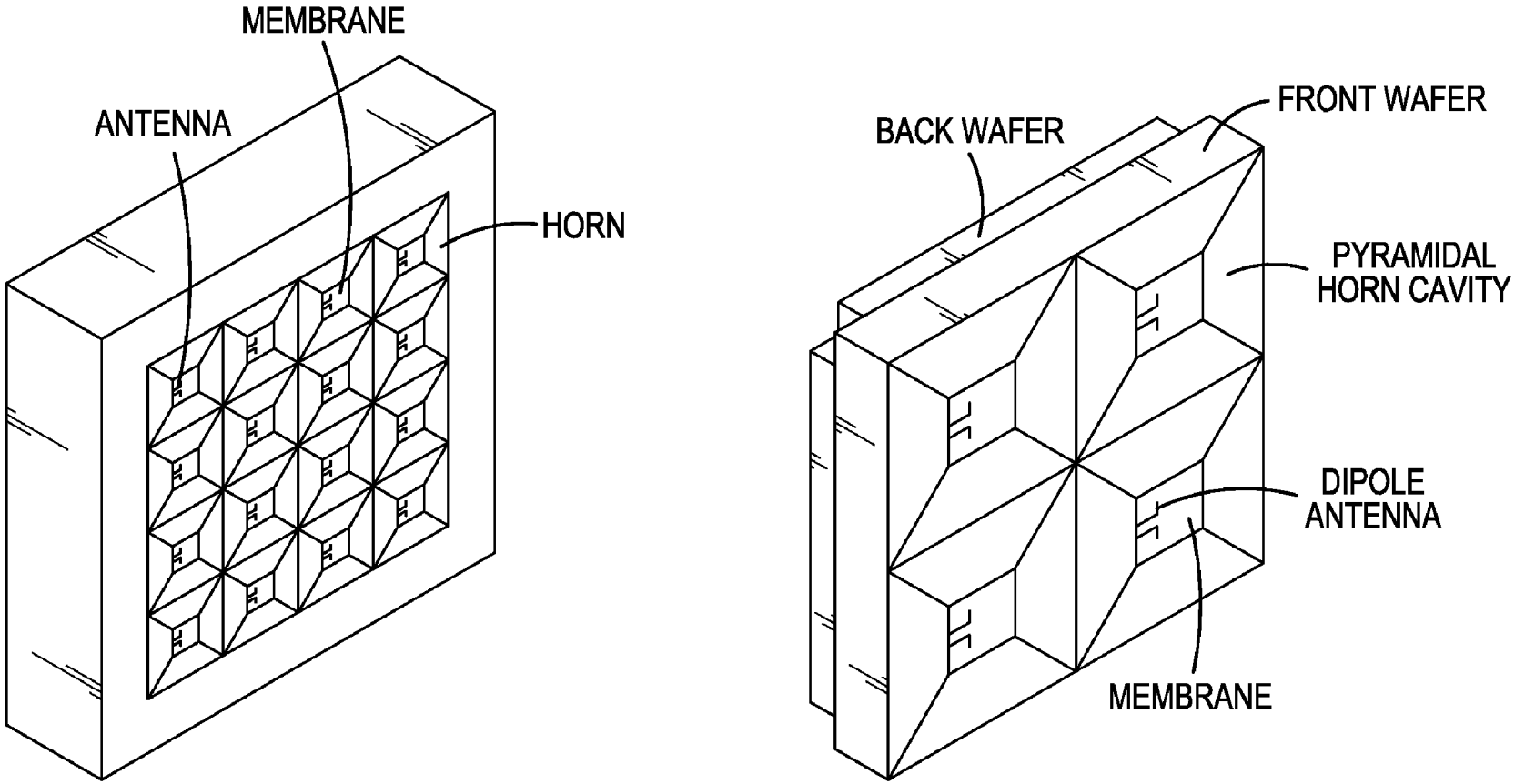
FIGS. 9 and 10 illustrate a 94 GHz integrated horn antenna array.
Figure 10:
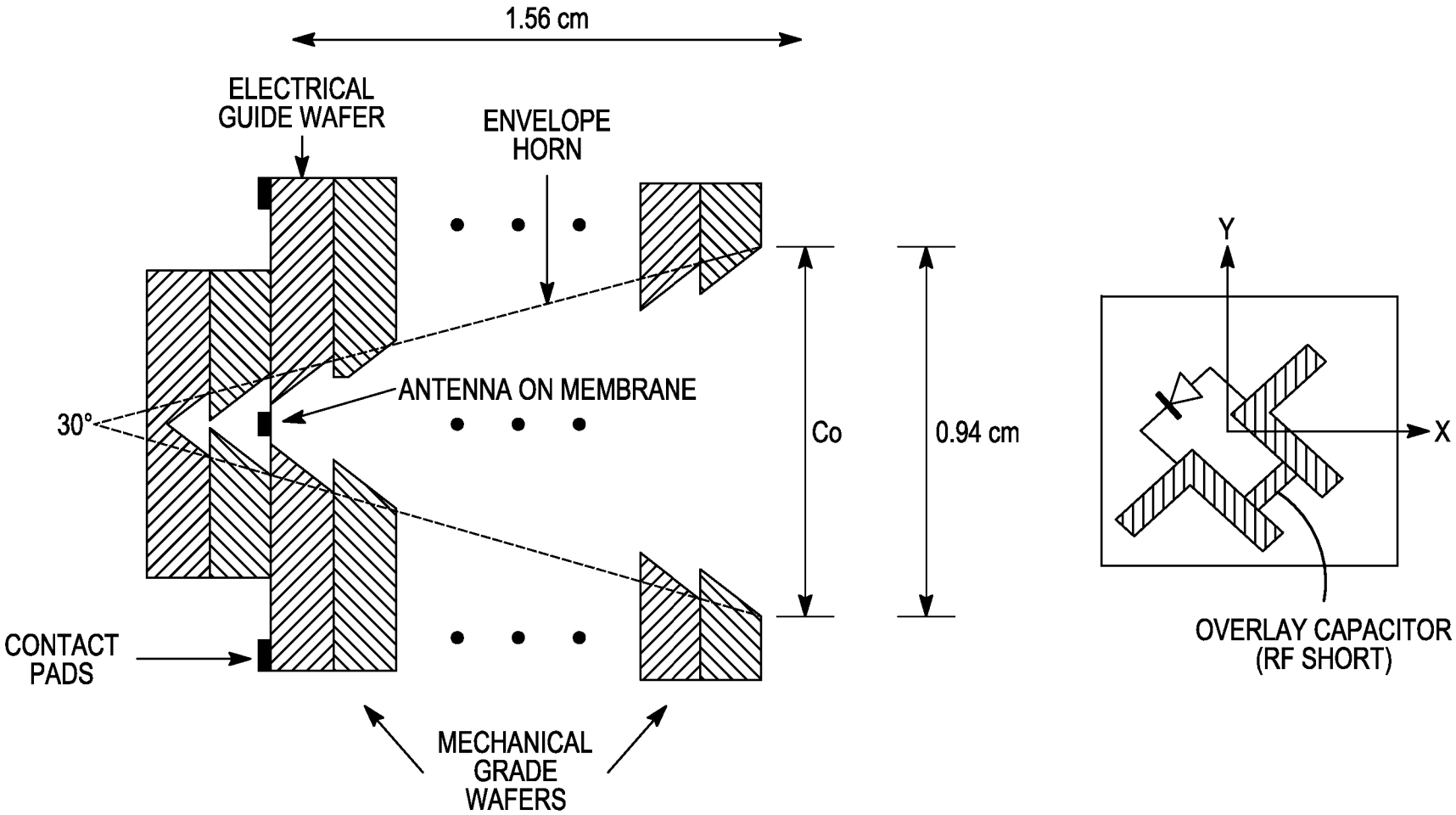

The state of the art in 94 GHz antenna array is shown in FIG. 9. This figure describes a micro machined horn based antenna array with an approximate thickness of 1.56 CM. The disclosed technology here produces a 3D integrated ultra thin monolithic antenna array integrated together with the conversion circuits with an overall thickness of less than 1 millimeter.

The novelty of our technology lies 1) The uniquely designed composite slot array consisting of the quartz and Si matching layers suppress the unwanted microwave modes in the substrate and produces a reception pattern with better than 20 dB suppression of the side lobes. As a result, pixels can be placed very close to each other producing high density pattern for the antenna and its conversion circuit. 2) Simple process technology for fabrication of the antenna array 3) Design of SBD array and corresponding matching circuits, geometrically layed out to meet the "footprint" of the pixels 4) 3D integration of the Active circuits to produce a monolithic power device.

Current feed-horn based integrated rectenna arrays at 94 GHz are difficult to fabricate and are too thick (1.5 cm). The processing of the rectenna limits its yield and the thickness of rectenna prevents its use in small sensor networks as an energy conversion element. Also conversion of the RF waves into DC power will require a layer of power conversion elements (rectifiers and matching network) that is hard to integrate with the horns. This combination of issues prohibits the development of monolithic power source at this frequency A new generation of Si based low profile slot based compost antenna array is developed that can readily be integrated with the Si based (or GaAs based) conversion circuitry enabling the construction of an all in one ultra thin 94 GHz power conversion source.

Figure 1:
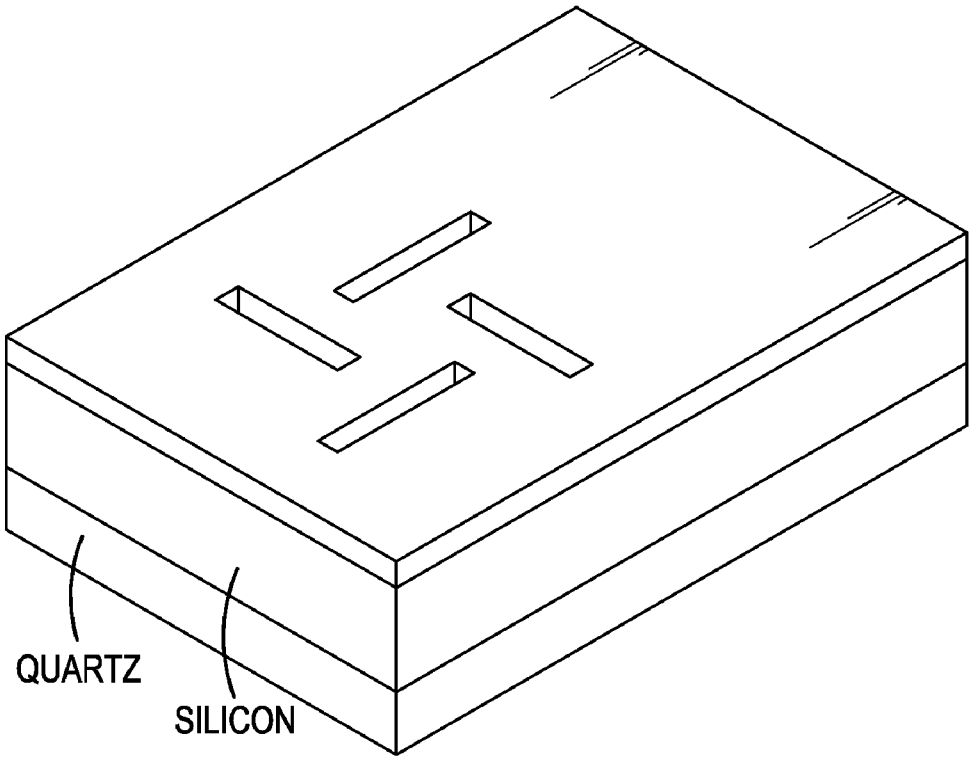
FIGS. 1, 2, and 3 illustrate an antenna at 94 GHz.
Figure 2:
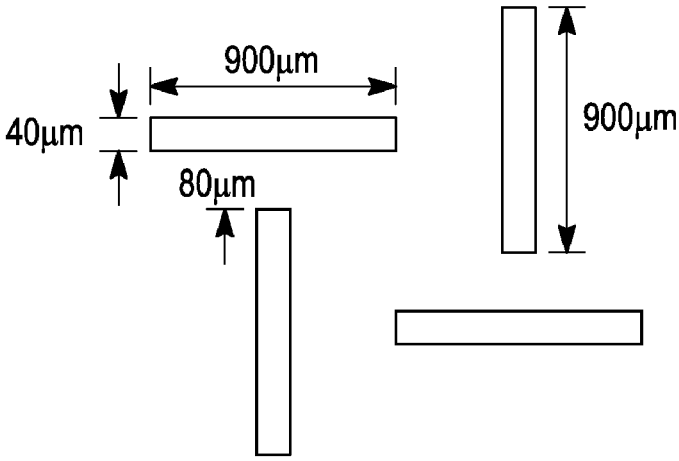
Figure 3:
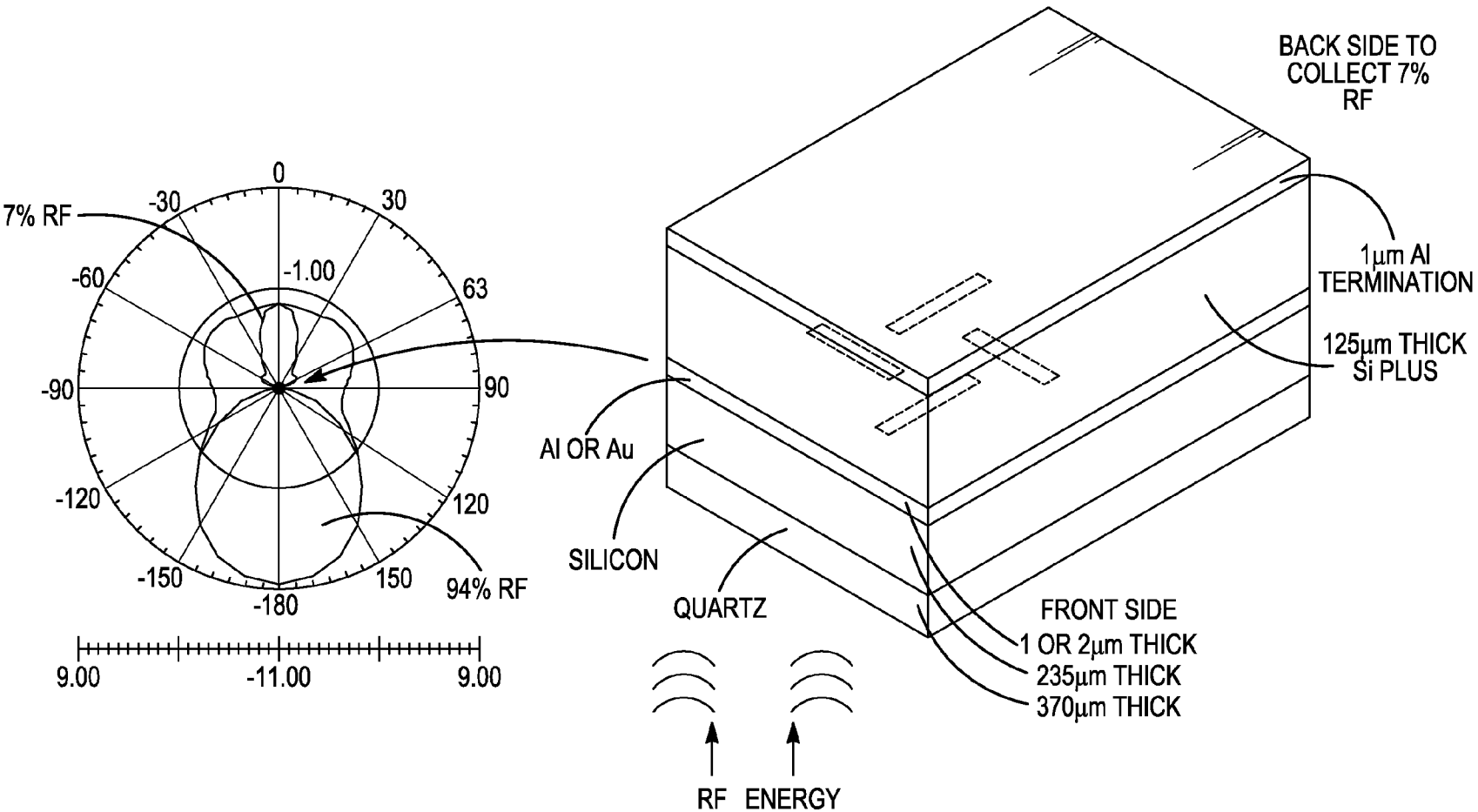

The solution consists of three steps 1) the slot based composite antenna array, 2) Si based integrated power converter array circuit and 3) the 3-D integration using micro-fabrications technology. Description of the integrated system is as follows:

1.0) The Antenna Array:

The cross section of a single element (pixel) of the composite slot based array is shown in FIG. 1. The structure consists of a 370 um thick quartz layer, followed by a 235 um thick Si layer (resonant mode) and a 1 um thick layer of Al (or Au). Offset cuts on the metal lawyer, placed in X and y direction (polarization) from the slots of antenna array. The sizes of the cuts are shown in FIG. 2 and match the frequency of the antenna or 94 GHz. The design is optimized in a way not to excite lossy grating lobes (substrate mode). The antenna efficiency is 75%, and could be increased to 94% using resonant Si substate (235 um Si thickness). Side lobes at −20 dB and cross-polarization better than 20 dB. The antenna reception pattern is shown in FIG. 3. In this configuration the antenna will collect approximately 92 to 93% of the RF energy. Note that 7% RF energy is going beyond the metal plane and can be collected by using a ¼ waveform thick Si stub placed in the back of the antenna array (FIG. 3) 2.0) The RF to DC conversion circuits consists of a dipole pick up electrode corresponding matching networks, a high speed rectifying diode, a low pass L_C filter which also acts as a a storage capacitor. The matching networks are made of the micros-trips while the SBD is typically made with GaAs diode. However, recently new technologies such as Si/SiGe 8 HP process technology offered by IBM and Jazz Semiconductor are offering Si based SBD's capable of operating to THz frequencies as part of their device set. Hence it is now possible to design the diode array using this type of process technology. Si based diode arrays provide us with a degree of freedom in miniaturization and allows us to consider (see below)

3.0) The 3-D Integration Technology.

Figure 4:
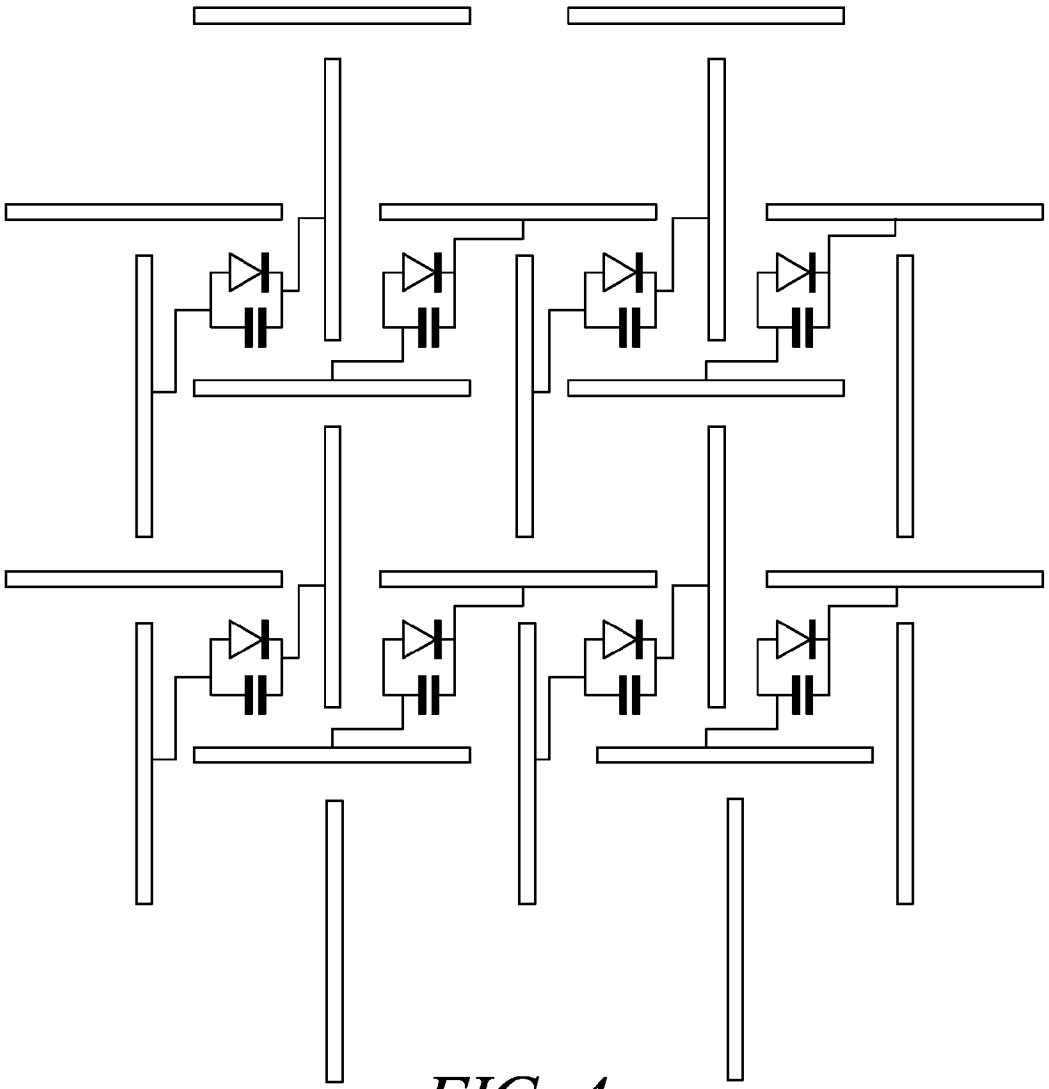
FIG. 4 illustrates a rectenna at 94 GHz.
Figure 5:
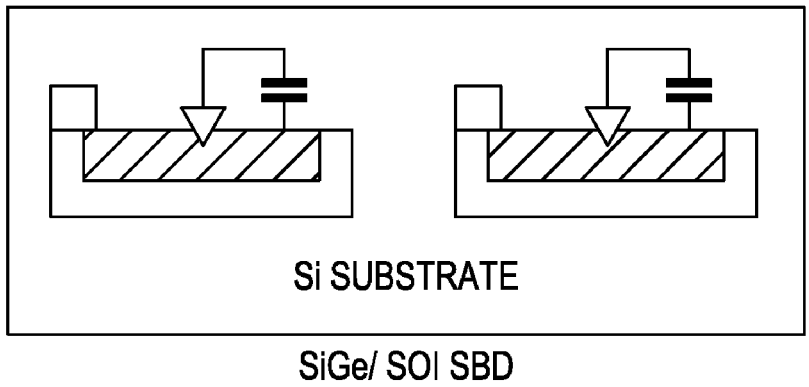
FIGS. 5, 6, 7, and 8 illustrate an integrated Si rectenna.
Figure 6:
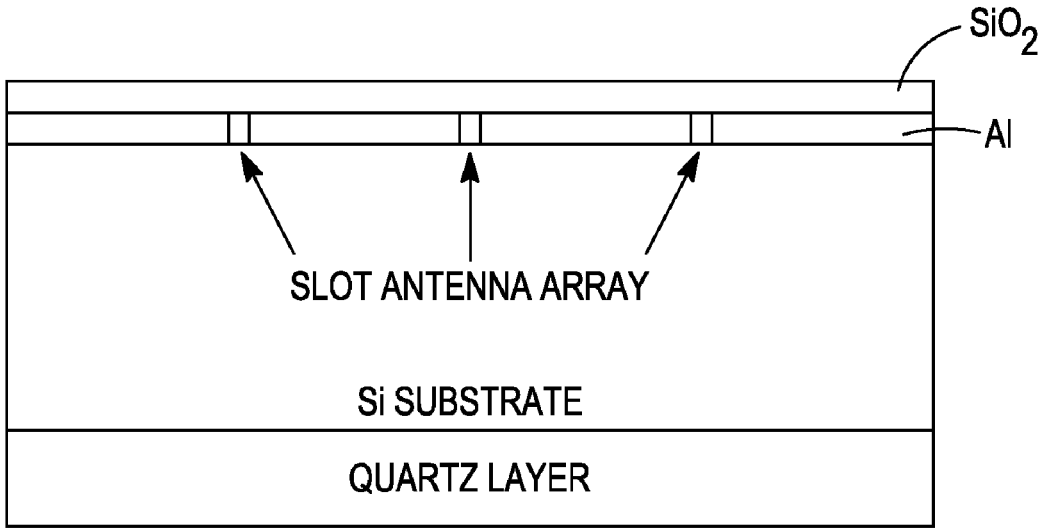
Figure 7:
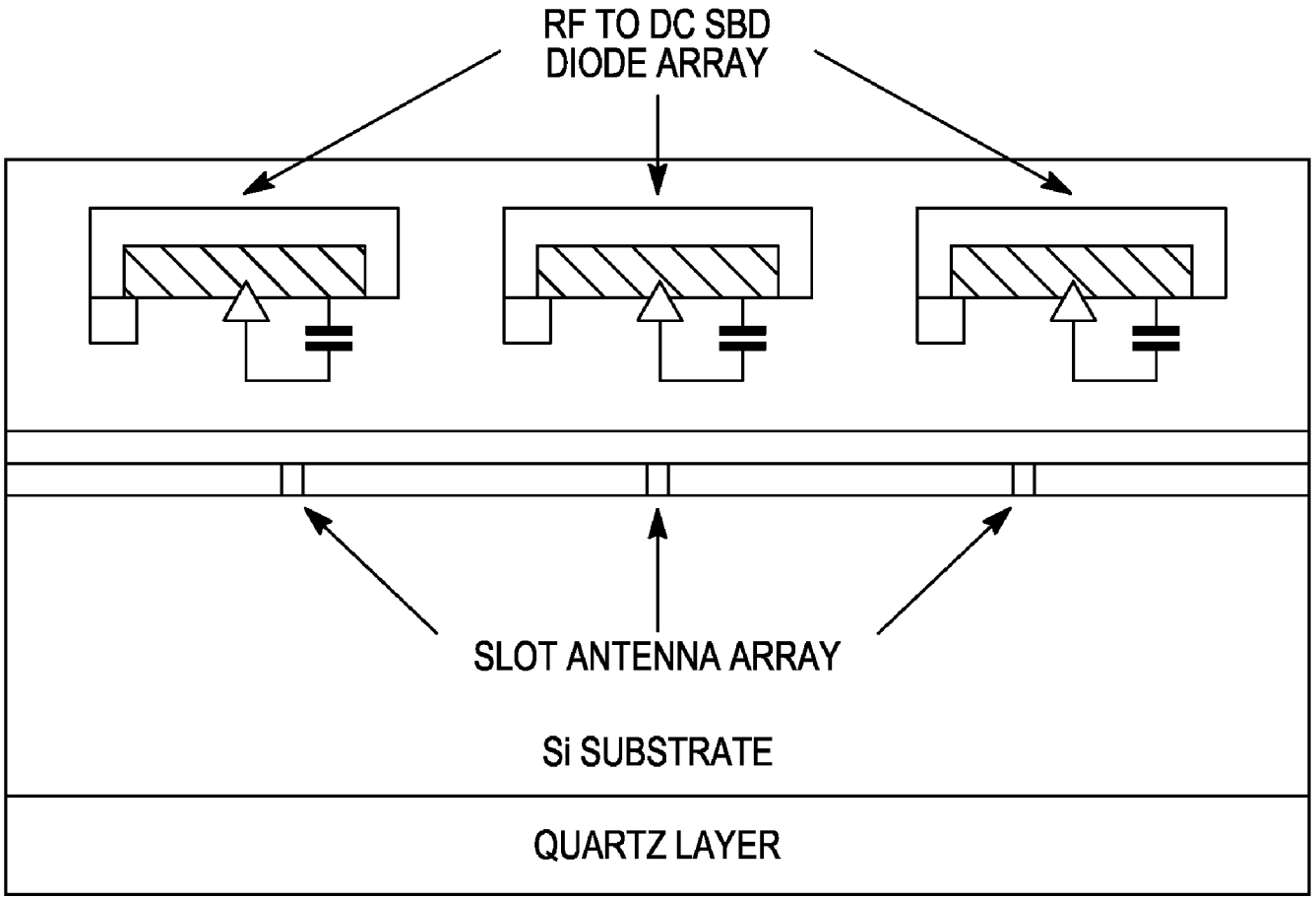
Figure 8:
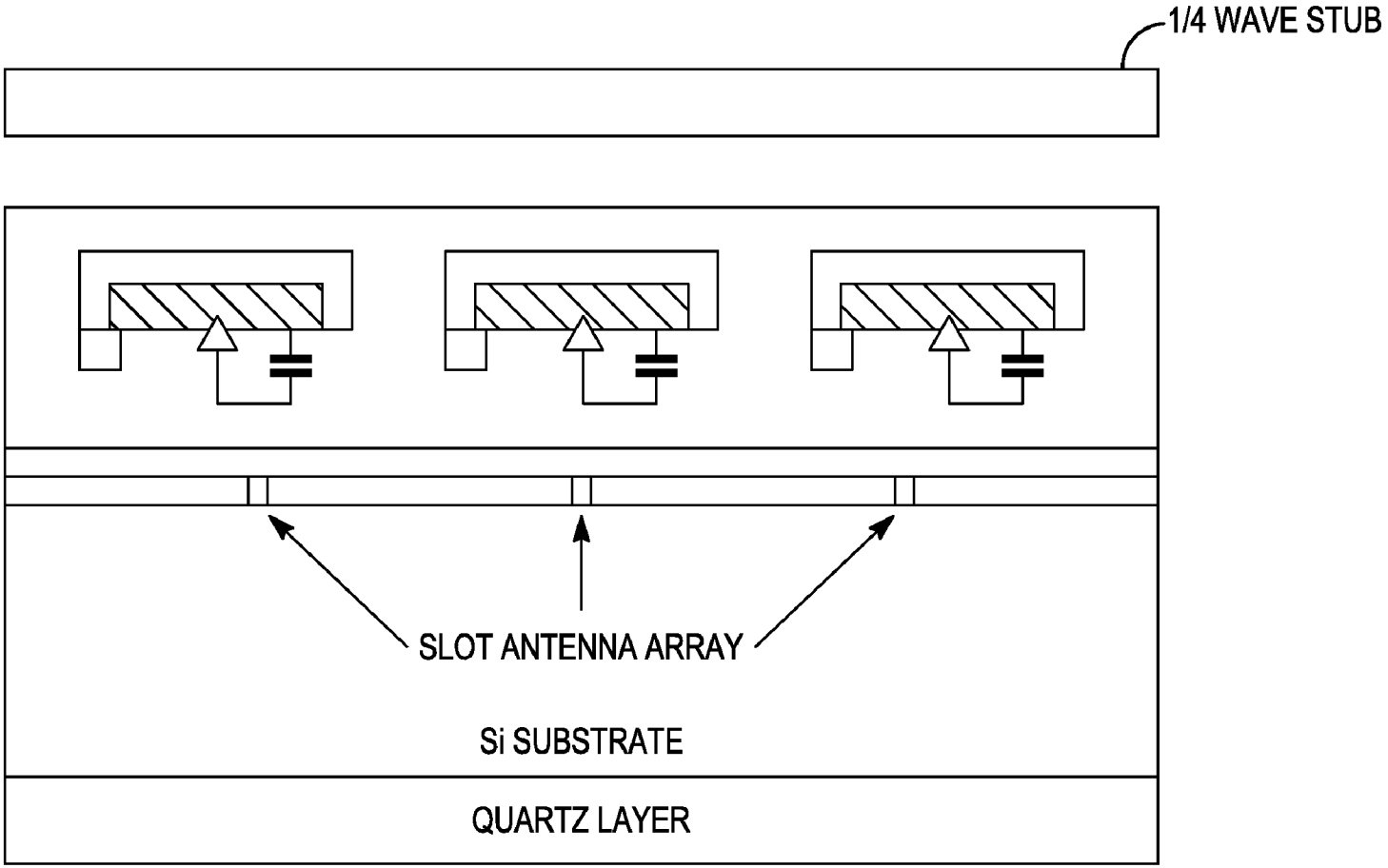

The antenna array can be made on a Si wafer using simple five step Si process technology. The steps include depositing metal on the Si, patterning and etching of the slots, depositing a fine layer of SiO2 over the slots, and attaching the Si substrate to a companion quartz wafer. FIG. 4 shows the RF to DC conversion circuit needed for the antenna array. Each pixel requires two separate conversion circuits, one for the X polarization and the second one for the Y polarization. The circuits can be fabricated using the Si based SBD. One possible cross section for these circuits is shown in FIG. 5 which is based on the Jazz Semi process SOI CMOS process. This particular process uses SOI wavers. The buried oxide in this process technology acts as a natural etch stop and is ideal for removing the excess Silicon of substrate. The SBD's and any other necessary circuits such as the power management and distribution circuits (DC-DC converters) can be fabricated on this process. However, care needs to be placed in geometrical placement of the SBD's to match the geometrical position of the slots in the antenna. Once this circuit is made on a wafer, the wafer can be turn upside down and bonded with the antenna array wafer (FIG. 6) any excess Si can be removed (FIG. 7). In an alternative configuration, ¼ wave Si based stub can be realized by thinning the top Si to a desired thickness and adding a final layer of metal to the back of the wafer (usually Au) (FIG. 8).

Integration Choices: Integrate antenna array with microstrip and capacitor; use commercial GaAs SBD; and flip chip onto antenna. Second revision options: MBE deposition of GaAs SBD; (high GaAs efficiency, process development and optimization); 3D integration of Si SBD with antenna array (proven Si technology, rapid integration and demonstration, low integration costs). Initial Demonstration: Pitch is 510 um, 20 by 20 array will be 1.2 cm by 1.1 cm; 3D size is 1.2 cm by 1.1 cm by 1 cm; power capability of approximately 1.2 W (3 mW/rectenna); foldable membrane power source; technology similar to flexible membrane SAR; enables folding and stowing of the power sheet in the back pack of the war-fighter; thin integrated tiles can be embedded into flexible membranes.

Quantitative impact (low power sensors network): Ultra thin scalable power source for mW to kW power applications; light weight, foldable membrane based power sheet can be carried out in war fighter backpack; enables transfer of power during night for distributed power sensors; expandable, allows deployment of aggregate number tiles for larger and larger power levels; four times more efficient than solar arrays (under the same input power density of 0.1350 W/cm$^2$); capable of processing up to 1.2 W/cm$^2$ of microwave power; twenty times reduction in thickness compared to integrated horn antenna achieved by use of planar ultra thin (0.78 mm) integrated antenna array; 30% improvement in efficiency produced by revolutionary new slot based antenna technology; ten times reduction in cost because of the ease of manufacturing; enhanced functionality because of on-chip power management; scalable to support different applications; multiple applications, power system for infield army applications, distributed sensor networks.

What is claimed is:

1. An RF system comprising:

a metal layer having a first major surface and a second major surface, the metal layer further having a first set of slots oriented in a first direction and a second set of slots oriented in a second direction that is substantially orthogonal to the first direction, the two sets of slots collectively configured to operate as an antenna at a desired radio frequency, wherein each of the slots in the first set of slots and the second set of slots is an opening extending from the first major surface to the second major surface of the metal layer;

a silicon layer having a third major surface and a fourth major surface, the third major surface of the silicon layer located substantially parallel to, and facing, the first major surface of the metal layer; and a quartz layer having a fifth major surface and a sixth major surface, the fifth major surface of the quartz layer located substantially parallel to, and facing, the fourth major surface of the silicon layer.

2. The system of claim 1, wherein the third major surface of the silicon layer is in direct contact with the first major surface of the metal layer, and the fifth major surface of the quartz layer is in direct contact with the fourth major surface of the silicon layer.

3. The system of claim 1, wherein the metal layer is substantially 1 um thick, the silicon layer is substantially 235 um thick, and the quartz layer is substantially 370 um thick.

4. The system of claim 1, wherein each of the first and the second set of slots comprises two rectangular slots, and the four slots are arranged to constitute a composite slot that is a single element of the antenna.

5. The system of claim 4, further comprising an RF-to-DC conversion circuit, wherein the conversion circuit includes at least one rectifying diode and at least one storage capacitor.

6. The system of claim 4, wherein the composite slot is configured to include a first RF-to-DC conversion circuit associated with an X-polarization, and a second RF-to-DC conversion circuit associated with a Y-polarization of the antenna.

7. A method of fabricating an RF system, the method comprising:

depositing a metal layer upon a silicon substrate, the metal layer having a first major surface and a second major surface, the silicon substrate being located upon a quartz layer and having a third major surface and a fourth major surface, the third major surface of the silicon substrate being located substantially parallel to, and facing, the first major surface of the metal layer, the quartz layer having a fifth major surface and a sixth major surface, the fifth major surface of the quartz layer located substantially parallel to, and facing, the fourth major surface of the silicon layer;

patterning and etching on the metal layer, a first set of slots oriented in a first direction and a second set of slots oriented in a second direction that is substantially orthogonal to the first direction, wherein the dimensions of the two sets of slots are selected for collectively operating as an antenna at a desired radio frequency of operation and wherein each of the first and the second set of slots comprises two rectangular slots, and the four slots are arranged to constitute a composite slot that is a single element of the antenna;

depositing a layer of silicon dioxide upon the metal layer; and providing an RF-to-DC conversion circuit, the conversion circuit including a matching circuit, at least one rectifying diode, and at least one storage capacitor.

8. The method of claim 7, wherein the matching circuit comprises at least one microstrip that is geometrically aligned to match a footprint of the composite slot.

9. The method of claim 8, wherein the at least one rectifying diode is a silicon based diode formed in the silicon substrate.

10. The method of claim 9, further comprising:

thinning the silicon substrate to form a quarter-wavelength stub.

11. A method of fabricating an RF system, the method comprising:

depositing a metal layer upon a silicon substrate, the metal layer having a first major surface and a second major surface, the silicon substrate being located upon a quartz layer and having a third major surface and a fourth major surface, the third major surface of the silicon substrate being located substantially parallel to, and facing, the first major surface of the metal layer, the quartz layer having a fifth major surface and a sixth major surface, the fifth major surface of the quartz layer located substantially parallel to, and facing, the fourth major surface of the silicon layer;

patterning and etching on the metal layer, a first set of slots oriented in a first direction and a second set of slots oriented in a second direction that is substantially orthogonal to the first direction, wherein the dimensions of the two sets of slots are selected for collectively operating as an antenna at a desired radio frequency of operation and wherein each of the first and the second set of slots comprises two rectangular slots, and the four slots are arranged to constitute a composite slot that is a single element of the antenna;

depositing a layer of silicon dioxide upon the metal layer; and providing a first RF-to-DC conversion circuit associated with an X-polarization, and a second RF-to-DC conversion circuit associated with a Y-polarization of the antenna.

* * * * *

UNITED STATES PATENT AND TRADEMARK OFFICE

CERTIFICATE OF CORRECTION

PATENT NO. : 8,193,995 B2
APPLICATION NO. : 12/468253
DATED : June 5, 2012
INVENTOR(S) : Mohammad M. Mojarradi et al.

It is certified that error appears in the above-identified patent and that said Letters Patent is hereby corrected as shown below:

In column 1, line 3, the following wording should appear:

STATEMENT REGARDING FEDERALLY SPONSORED RESEARCH OR DEVELOPMENT

The invention described herein was made in the performance of work under a NASA contract, and is subject to the provisions of Public Law 96-517 (35 USC 202) in which the Contractor has elected to retain title.

Signed and Sealed this
Twenty-fourth Day of July, 2012

David J. Kappos

David J. Kappos
*Director of the United States Patent and Trademark Office*